US011524519B2

(12) United States Patent
Ertl

(10) Patent No.: US 11,524,519 B2
(45) Date of Patent: Dec. 13, 2022

(54) CUSTOMIZABLE THERAPY CLIP FOR A WRITING INSTRUMENT

(71) Applicant: Caroline Lawrence Ertl, Ridgefield, CT (US)

(72) Inventor: Caroline Lawrence Ertl, Ridgefield, CT (US)

(73) Assignee: Caroline Lawrence Ertl, Ridgefield, CT (US)

( * ) Notice: Subject to any disclaimer, the term of this patent is extended or adjusted under 35 U.S.C. 154(b) by 344 days.

(21) Appl. No.: 17/001,261

(22) Filed: Aug. 24, 2020

(65) Prior Publication Data

US 2022/0055398 A1 Feb. 24, 2022

(51) Int. Cl.
*B43K 25/02* (2006.01)
*B43K 29/10* (2006.01)
*B43K 29/00* (2006.01)

(52) U.S. Cl.
CPC ..... *B43K 25/026* (2013.01); *B43K 25/024* (2013.01); *B43K 29/004* (2013.01); *B43K 29/10* (2013.01)

(58) Field of Classification Search
CPC .. B43K 29/002; B43K 29/004; B43K 25/024; B43K 25/026
See application file for complete search history.

(56) References Cited

U.S. PATENT DOCUMENTS 1,388,219 A * 8/1921 Thompson ..... B43K 25/024 24/11 CC
1,479,957 A * 1/1924 Cruver ..... B43K 25/024 24/11 F
1,754,582 A * 4/1930 Spencer ..... B43K 25/024 24/11 M
2,094,796 A * 10/1937 Kahn ..... B43K 25/026 40/334
2,141,990 A * 12/1938 Kahn ..... G09F 7/08 D19/197
2,141,991 A * 12/1938 Kahn ..... G09F 7/08 40/334
2,159,745 A * 5/1939 Marshall ..... B43K 25/026 40/334
3,590,441 A * 7/1971 Goldberg ..... B43K 25/02 40/334

(Continued)

FOREIGN PATENT DOCUMENTS

WO WO-2005068217 A1 * 7/2005 ..... B43K 29/00

*Primary Examiner* — Joshua T Kennedy

(57) ABSTRACT

A clip comprised of removably attached components. The clip may be attached to a writing instrument, such as a pencil, or stylus. The surface of the clip has male elements that allow the components to snap on to the clip so that the clip may be adorned. The components are secured to the clip so that they may rotate freely around the male element. The components may be comprised of decorative elements, such as jewels, initials, logos, or pictures. The components may be comprised of a utilitarian element, such as a lanyard, or a flashing light to indicate an incoming email. The components may have a tactile surface comprised of bumps, or waves. The components may comprise of movable elements such as a rolling ball, or star that spins. The tactile surface and moving elements of a component may aid in the treatment of anxiety and attention deficit disorders.

12 Claims, 1 Drawing Sheet

(56) References Cited

U.S. PATENT DOCUMENTS

| | | | | |
|---|---|---|---|---|
| 6,019,536 | A * | 2/2000 | Lee | B43K 23/08 401/98 |
| 6,890,116 | B1 * | 5/2005 | Petroskey | B43K 25/026 401/104 |
| 9,211,757 | B2 * | 12/2015 | Osborne | B43K 29/00 |
| 9,858,827 | B2 * | 1/2018 | Shirvani | G09B 1/36 |
| 9,950,556 | B1 * | 4/2018 | Laemle | B43K 23/08 |
| 2020/0128927 | A1 * | 4/2020 | Beatty | A44B 17/0058 |

* cited by examiner

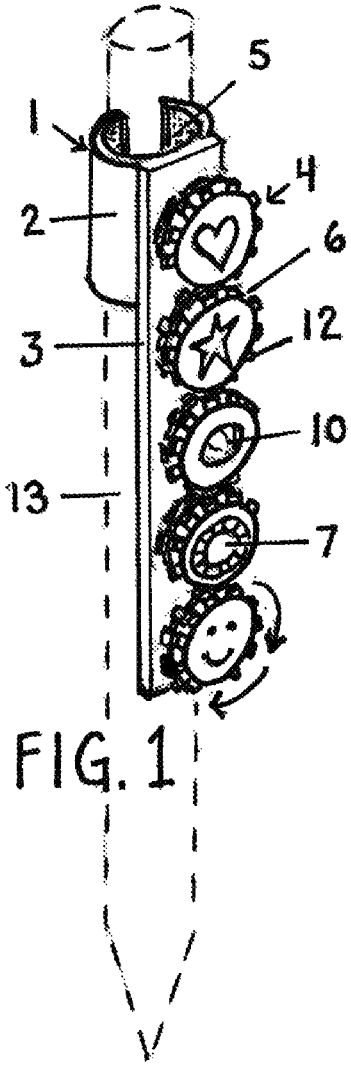
FIG. 1
FIG. 2
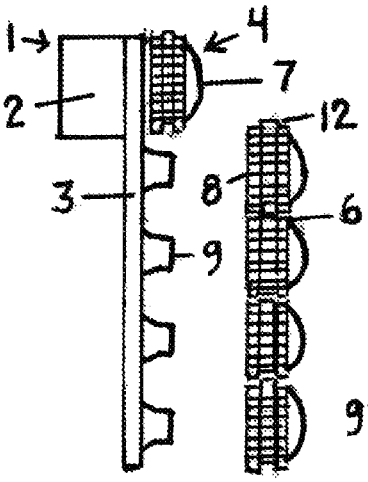
FIG. 3
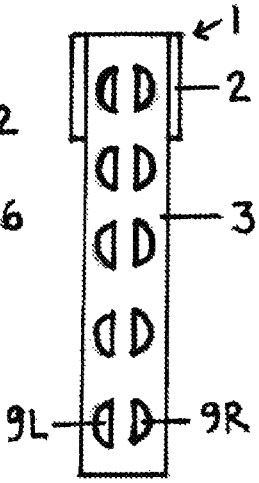
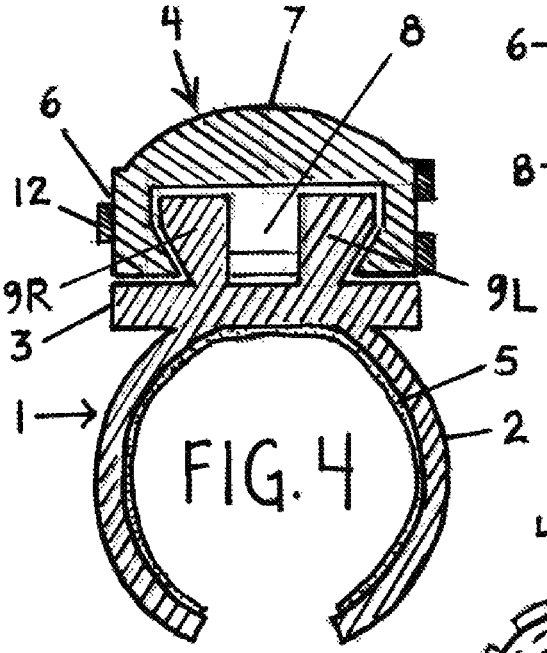
FIG. 4
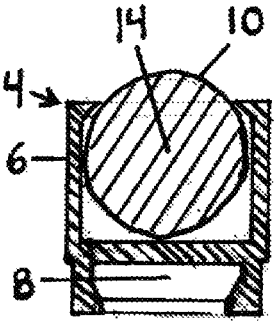
FIG. 5
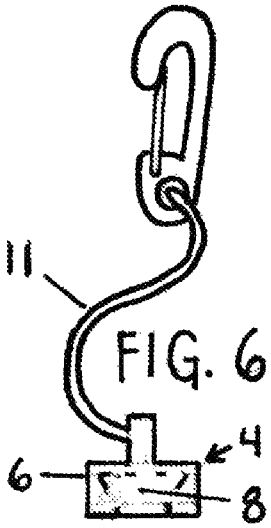
FIG. 6
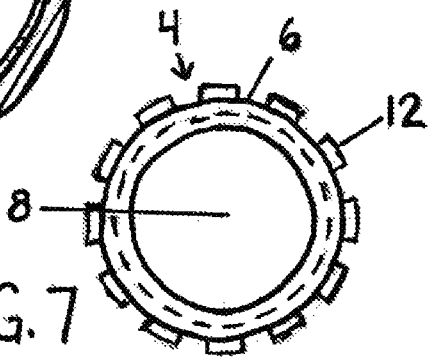
FIG. 7

CUSTOMIZABLE THERAPY CLIP FOR A WRITING INSTRUMENT

PRIORITY

This application is based on provisional patent application Ser. No. 62/865,925 filed on date Jun. 24, 2019

BACKGROUND OF INVENTION

1. Field of the Invention

The present invention relates to the clip on a personal writing device, such as a pen or pencil. More specifically the present invention allows multiple ornamental or therapeutic components to be removably attached to the clip. The present invention allows owners to personalize their writing instrument. Additionally, the present invention relates to a fidget device that provides therapeutic relief for anxiety and attention deficit therapy.

2. Discussion of Related Art

Writing devices, such as pencils and styluses are used daily by the majority of the public. While pen clips provide a way to fasten instruments to an item such as a pocket, they are usually a simple design and not decorative. Many pencils and styluses do not come with a clip attached. Writing utensils, such as pencils and styluses, are often hard to tell apart and most clips, if provided, do not allow the user to differentiate their writing instrument from another writing instrument.

There are devices, such as the Fidget Spinner, U.S. Pat. No. 9,895,620 issued to Walterscheid, that serve to help treat anxiety and attention deficit disorders in the classroom. However, hand held spinners are not discreet therapies. People also tend to fidget with the top of the pen by repeatedly pressing the top to retract and release the pen tip. The components of the present invention that attach to the clip may be designed to help treat these disorders without bringing attention to the user as it is disguised as a decorative clip.

U.S. Pat. No. 7,179,005, issued to Cetera; Carl on Feb. 20, 2007 is a permanently affixed clip for a hand held writing instrument comprised of two rails with a single sliding member between the rails that may have indicia such a logo or graphic. The present invention is not permanently attached to a writing instrument, allowing the clip to be removed from one writing instrument and attached to another writing instrument. The present invention allows for a variety of components, such as a rolling ball, a toggle, or tactile bumps, to be attached that may aid in the treatment of anxiety and attention deficit disorders. The present invention allows for the attachment of a component that may include a lanyard to anchor a writing instrument to a counter, backpack, or the like.

While many inventions exist that provide decorative and playful elements to writing instruments, they are mainly permanently fixed to the writing instrument and do not allow for customization as the present invention does. See U.S. Pat. No. 6,688,794 to Hsu, U.S. Pat. No. 9,387,412 to Truckai, U.S. Pat. No. 6,254,298 to Hsu, U.S. Pat. No. 2,644,212 to Markowitz, U.S. Pat. No. 6,129,473 to Shu, U.S. Pat. No. 2,141,990 to Kahn.

U.S. Pat. No. 4,012,155 issued to Morris on Mar. 15, 1977 is a snap lock connector system for furniture. This is a similar system design to connect the components of the present invention to the clip.

INVENTION SUMMARY

The present invention is a stand alone clip that can be detachably secured to any writing instrument without an exiting clip. The clip serves as a base that removably attached components may snap on to. The components may serve multiple purposes and can be decorative, therapeutic, or utilitarian.

The device allows for people to customize their writing instrument so that it is easily identifiable as their own. The removably attached components may be decorative, such as, but not limited to, initials, numbers, images, emojis, logos, lights and photos. The interchangeable components may be removed and replaced allowing the clip look to change.

The removable components may have moving parts, such as, but not limited to, a ball or star that, twirl, toggle, roll, or the like. The removable components may also have a tactile sensory surface such as, but not limited to, bumps, waves, or the like. The moveable and tactile properties may accommodate individuals who utilize touch therapy to treat anxiety and attention deficit disorders.

The component may be designed to include a lanyard that may secure a writing instrument, such as a pencil, to an item such as a desk, note pad or backpack. The clip may aid in keeping a smooth writing instrument, such as a stylus, from rolling off a table.

The present invention is a customized clip that may allow the user to identify a writing instrument as their own. This may help prevent the spread of germs by deterring others from using the writing instrument, such as a pencil.

BRIEF DESCRIPTION OF THE FIGURES

FIG. 1 is a perspective view of the preferred embodiment of the present invention as it relates to a writing instrument.

FIG. 2 is a side view of the clip illustrating a method for attaching the components to the clip.

FIG. 3 is a front view of the clip without components attached illustrating the male elements.

FIG. 4 is a vertical cross section looking down from the top of the clip with component attached illustrating how a component fits onto the clip.

FIG. 5 is a vertical cross section through a component that contains a ball that rolls freely.

FIG. 6 Is a side view of a component with lanyard.

FIG. 7 is a bottom view of a component with tactile sensory bumps illustrating the female cavity.

DETAILED DESCRIPTION OF THE PREFERRED EMBODIMENTS

Advantages of the present invention will be appreciated as it is better understood by reference to the following detailed description when considered in connection with the accompanying drawings, wherein:

FIG. 1 is a perspective view of the preferred embodiment of the present invention as it relates to a writing instrument 13. The preferred embodiment of the present invention is a clip 1 comprised of at least one band 2 and at least one stem 3 with removably attached components 4.

In this preferred embodiment the present invention includes at least one band 2 that may snugly grasp onto a writing instrument 13. The band 2 may be an open circle that allows for the clip 1 to be removed from a writing instrument 13 and attached to a different writing instrument 13. The clip 1 band 2 may grasp a writing instruments 13 of various widths such as a pencil, stylus, marker, or pen. The inner surface of the band 2 may be lined 5 with an element, such as rubber, or teeth, that may prevent the clip 1 from sliding down the shaft of the writing instrument 13.

In this preferred embodiment, the present invention comprises of at least one stem 3 with male elements, as illustrated in FIG. 2, FIG. 3 and FIG. 4, that may receive multiple removable components 4 with correlating female cavity, as illustrated in FIG. 4 and FIG. 7. A component 4 may move independently when attached to the stem 3, allowing it to rotate freely around the male element. The side 6 of a component 4 may be smooth or may comprise of tactile sensory elements 12 such as, but not limited to, bumps or waves.

In this preferred embodiment, the top of the component 4 may have a decorative element 7 such as, but not limited to, a logo, letter, bead, jewel, or emoji. The component 4 may incorporate a movable element 10, such as, but not limited to, a ball that can roll, as illustrated in FIG. 5, toggle, or the like. The component 4 may have a light feature that may flash for an incoming text as it communicates with another device. The component 4 may be comprised of a lanyard to anchor a writing instrument 13 to a desk, table, bag, or the like, as illustrated in FIG. 6. The varying features of the components 4, such as the ability to rotate, be comprised of a movable element 10, or the side 6 featuring tactile elements 12, may serve to create mild distractions to aid in the treatment of anxiety and attention deficit disorders.

The components 4 are removable and may be detached and replaced as the user desires, so that the user may continually customize and personalize the clip 1. This customization allows users to identify a writing instrument 13 as their own, which may prevent others from using the writing instrument 13 and potentionally spreading germs.

In some embodiments, the clip 1 and components 4 may be comprised of a variety of suitable materials, such as, but not limited to, plastic, resin, metal, silver, gold, aluminum, or wood.

FIG. 2 is a side view of the clip 1 illustrating a method for attaching a component 4 to the clip 1. The component 4, in this preferred embodiment has a decorative element 7, and the side 6 of the component 4 has tactile sensory bumps 12. The component 4 may have a correlating female cavity 8, as further illustrated in FIG. 4 and FIG. 7, that may be pressed down on to the male elements 9, as further illustrated in FIG. 3 and FIG. 4, that are situated along the clip 1 stem 3. As the component 4 is pressed down onto the male element 9, the male elements 9 are forced closer together as they pass through the narrow part of the female cavity 8 located at the bottom of the component 4. The male elements 9 return to their original position when the top of the male elements 9 enter the larger opening of the female cavity 8 within the component 4, thus locking the component 4 into place as illustrated in FIG. 4. The component 4 may be withdrawn from the male element 9 as the male elements 9 will be force inwardly allowing for release of the component 4.

FIG. 3 is a front view of the clip 1 comprising of a band 2, stem 3, and male element 9 L and 9 R, without components attached. The clip 1 in this preferred embodiment illustrates the male element 9L and 9R as it relates to the stem 3. The space between, and flexibility of, the male elements 9L and 9R allow the left element 9L and the right element 9R to be pressed towards each other when a component is pressed upon or removed from the male element.

FIG. 4 is a vertical cross section of the present invention looking down from the top of the clip 1 with component 4 attached illustrating how a component 4 fits onto the clip 1. The clip 1 is comprised of a band 2 and stem 3. The inner band surface may be lined 5 with rubber, teeth, or similar material that prevents the clip 1 from sliding down the writing instrument. The male elements 9R and RL line up along the surface of the stem 3. The component 4 is pressed down upon the male element 9R and 9L. The flexibility of the male element 9R and 9L allow them to move towards each other as they pass through the narrower opening of the female cavity 8 at the bottom of the component 4. The male elements 9R and 9L return to their original position as they enter the larger area of the female cavity 8 of the component 4. The component 4 is loosely secured on to the male element 9R and RL allowing the component 4 to freely rotate around the male element 9R and RL. The present component 4 comprises of a decorative element 7, and a side 6 with tactile sensory bumps 12. The tactile sensory bumps 12 may provide the user with mild stimulation that may aid in the treatment of anxiety and attention deficit disorders as the user slides a finger over the bumps 12 causing the component 4 to rotate around the male element 9.

FIG. 5 is a vertical cross section through a component 4, illustrating a component 4 that may contain a movable element 10, such as, but not limited to, a ball 14 that moves freely when manipulated by the user. The present component 4 comprises of smooth side 6, a female cavity 8, and an encased ball 14 that may roll freely within the component 4. The act of rolling the ball 14 under a users finger may provide the user with mild stimulation that may aid in the treatment of anxiety and attention deficit disorders.

FIG. 6 Is a side view of a component 4 with an example of a lanyard 11. The present component 4 comprises of a smooth side 6, a female cavity 8, and an illustration of a type of lanyard 11 that may be a feature of the component 4. This variation of the component 4 may allow the writing instrument to be secured to a table, backpack, or the like.

FIG. 7 is a bottom view of a component 4 illustrating the female cavity 8 with tactile sensory bumps 12 on the side 6 of the component 4. The cavity 8 at the bottom of a component 4 has a narrow opening leading to a larger opening within the component 4 into which the correlating male element of the stem is received.

The present invention has been described in an illustrative manner. It is to be understood that the terminology, which has been used, is intended to be in the nature of words of description rather than of limitation.

Many modifications and variations of the invention are possible in light of the above descriptions. Therefore, within the scope of the appended claims, the invention may be practiced other than as specifically described. To illustrate this, the mechanism used to attach the components to the clip may be substituted to include magnets, snap, screw on, or similar. To illustrate again, the components may be attach permanently so that they may not be able to be removed from the stem once snapped on. To illustrate again, the stem may accept a single or multiple components.

The invention claimed is:

1. A writing instrument clip configured to be removably attached to a writing instrument, comprising:

a band configured to wrap around a body of a writing instrument;

a stem extending from said band and having male elements located along the stem on an outer surface thereof; and removably attachable components having female elements secured to said male elements;

wherein said components each comprise projections on a peripheral surface thereof which engage projections on a neighboring removably attachable component of said removably attachable components to cause concurrent rotation of the components.

2. The writing instrument clip of claim 1, wherein the band further comprises an inner lining that is configured to grasp the writing instrument to prevent the clip from slipping down the writing instrument.

3. The writing instrument clip of claim 1, wherein each of the male elements of the stem comprise a shaft with lip that is configured to removably insert into a respective female element of a respective said removably attachable component.

4. The writing instrument clip of claim 3, wherein each of said female elements further comprise a cavity having a narrow opening which leads to a larger opening within the removably attachable component.

5. The writing instrument clip of claim 4 wherein said cavity is compatible with a respective one of said male elements on the stem.

6. The writing instrument clip of claim 5, wherein each of the removably attachable components are attached to a respective one of said male elements and is free to rotate around said male element on the stem.

7. The writing instrument clip of claim 1, wherein at least one of the removably attachable components further comprise a decorative element.

8. The writing instrument clip of claim 1, wherein at least one of the removably attachable components further comprise a utilitarian feature configured to secure the clip to another element, device, or user.

9. The writing instrument clip of claim 1, wherein at least one of the removably attachable components is further comprised of various sizes and shapes.

10. The writing instrument clip of claim 1, wherein at least one of the removably attachable components further comprises a moveable element that will roll, spin, rock, or toggle, whereby further sensory input is provided to the user of the clip.

11. The writing instrument clip of claim 1 wherein a surface of at least one of the removably attachable components is further comprised of three dimensional tactile sensory textures, whereby further sensory input is provided to the user of the clip.

12. The writing instrument clip of in claim 1, wherein the clip and removably attachable components are comprised of metal, gold, silver, plastic, resin, wood, or foam.

* * * * *